United States Patent [19]

Suk

[11] 4,378,039

[45] Mar. 29, 1983

[54] COLLAPSIBLE GOLF BAG

[76] Inventor: Young J. Suk, 59 Sandy Hollow Rd., Port Washington, N.Y. 11050

[21] Appl. No.: 254,992

[22] Filed: Apr. 16, 1981

[51] Int. Cl.[3] ..... A63B 55/00

[52] U.S. Cl. ..... 150/1.5 B; 248/96

[58] Field of Search ..... 150/1.5 R, 1.5 B; 248/96

[56] References Cited

U.S. PATENT DOCUMENTS

| | | | |
|---|---|---|---|
| 2,435,479 | 2/1948 | Thommen | 150/1.5 R |
| 2,855,967 | 10/1958 | Wycherley | 150/1.5 R |
| 4,200,131 | 4/1980 | Chitwood et al. | 150/1.5 R |

FOREIGN PATENT DOCUMENTS

| | | | |
|---|---|---|---|
| 340385 | 1/1931 | United Kingdom | 150/1.5 R |
| 434592 | 9/1935 | United Kingdom | 150/1.5 R |
| 625441 | 6/1949 | United Kingdom | 150/1.5 R |

*Primary Examiner*—William Price
*Assistant Examiner*—Sue A. Weaver
*Attorney, Agent, or Firm*—A. H. Golden

[57] ABSTRACT

A golf bag is formed of limp material for ready collapse and packaging, and for assembly to a series of rods to hold it in a longitudinal position. Each rod is formed of spring material for flexing whereby to shorten its effective length. When so flexed and placed in alignment with two opposed sockets at the ends of said golf bag, it may be released from flexed position for engagement with the sockets to hold the golf bag in a longitudinal tubular position.

5 Claims, 11 Drawing Figures

COLLAPSIBLE GOLF BAG

BACKGROUND OF INVENTION

This invention relates to a collapsible golf bag that may readily be converted to a conventional tubular elongated golf bag. Golf bags of this type have considerable utility in that they are readily collapsed for shipping from the factory to the retailer, and also by the final user. Further, they may be used as collapsible bags or stiffened for conventional use.

A bag of this type is shown in the British patent to Murdock, No. 625,441 of Sept. 4, 1949. He shows a collapsible golf bag with a series of rods entered into sheaths formed on the outer periphery of his bag. Each rod is retained in its sheath by a cloth flap. Murdock has only the concept of reinforcing ribs. He cannot exert end pressure on the golf bag body to hold it extended. His flap for holding each rod lacks durability and effectiveness.

In Thommen No. 2,435,479 we find a pair of spring circular members forming the upper rim and the bottom base of his bag. These are assembled to a single rod that has ribs and slots for the purpose. As will appear presently he does not have anything relating to the concept of my invention. However, Thommen and Murdock clearly illustrate the need for an effective bag of the class herein described and claimed by me.

SUMMARY OF INVENTION

I have conceived a very effective structure utilizing a cloth or other limp body having the usual upper conventional golf bag rim, and the usual bottom plate, both of which in modern golf bags are plastic cast. Sockets or the like are secured to the opposed ends of the golf bag body or to the rim and bottom plate. One form of socket is tubular, and the open ends of the sockets receive opposed ends of a rod. This rod is spring-like and flexing, and when flexed will be effectively shortened for alignment with the open ends of the sockets. When released from flexing it will enter fully into engagement with the sockets to hold the golf bag extended.

In order to compensate for manufacturing errors and tolerances, I prefer to use spring means in at least one of said sockets as will presently be described. I prefer also to use sheaths for guiding my rods and for holding them against the inside surface of the tubular golf bag body.

Those skilled in the art will appreciate that the socket and rod relationship may be reversed with pins secured to the golf bag body fitting into bores at the ends of the rod. Also, I may use a rod fitted at one end into a socket bore and at its other end fitted over a pin. Naturally, I may use one, two or even four rods.

DESCRIPTION OF INVENTION

Figure 1:
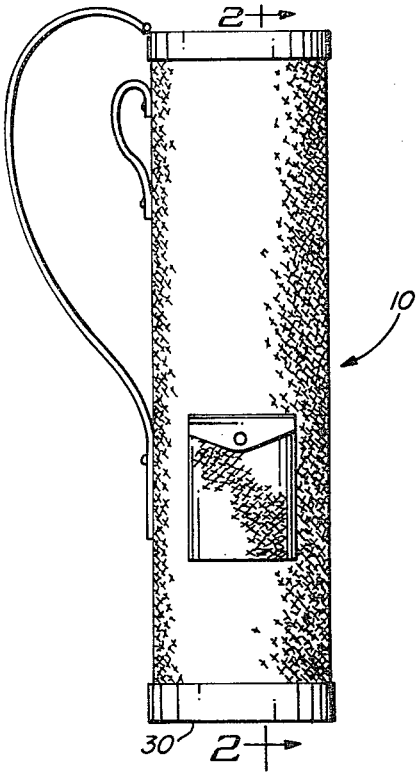
FIG. 1 is an elevation of a golf bag embodying my invention.
Figure 2:
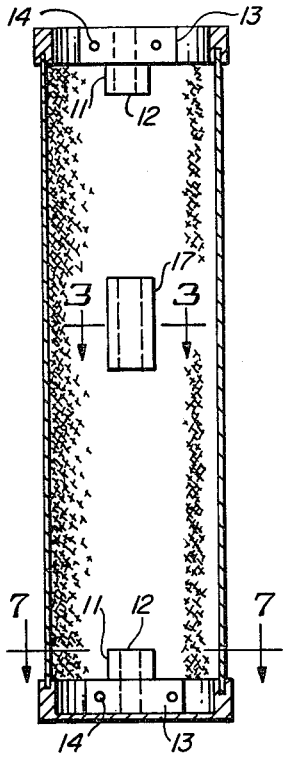
FIG. 2 is a section along line 2—2 of FIG. 1.
Figure 7:
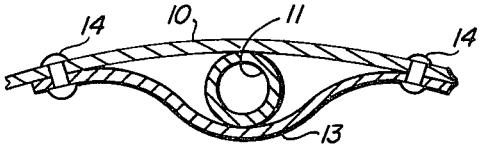
FIG. 7 shows how a socket may be secured.

Referring now more particularly to the drawings, a conventional golf bag is shown in FIG. 1 having a cloth or other limp material body 10. As seen in FIGS. 2 and 7, I use tubular sockets shown at 11 and each socket having an open end 12 with the said open ends in alignment vertically for use with a rod to be described presently. Sockets 11 may be cast integrally with the rim and bottom plate 30 of the golf bag as these parts are usually made of plastic castings. In my form of the invention here shown I use a bent strap 13 held by rivets 14 to hold the upper and lower sockets in effective alignment. It will be understood that the sockets 11 may be secured as by riveting or sewing to the limp material of the golf bag body if that is desired.

Figure 4:
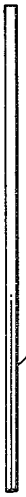
FIGS. 4 and 5 show the rod of my invention in normal unflexed position and flexed.
Figure 5:
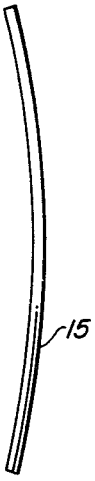

The rod of my invention is shown at 15 in FIGS. 4 and 5, and is made longer than the distance between the open facing ends 12 of aligned sockets 11. When flexed as in FIG. 5, the effective length of the rod 15 is obviously reduced. Now, to assemble a rod to the golf bag it is inserted into open end 12 of the lower socket 11. I then flex the rod to reduce its effective length and align its upper end with the open end of the upper socket 11. Obviously, upon release of the rod from flexing it springs fully into both sockets to be held securely, and to exert end pressure against the sockets to hold the bag elongated. Preferably, the rod is made longer than the distance between the bottoms of sockets 11 so as always to exert some slight end pressure against the sockets, by holding the rods slightly flexed. I believe the simplicity of assembly of a rod to the bag and its disassembly will be apparent.

Figure 3:
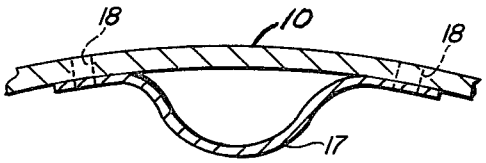
FIG. 3 is a section at line 3—3 showing how a sheath may be secured to the body of the bag.
Figure 3A:
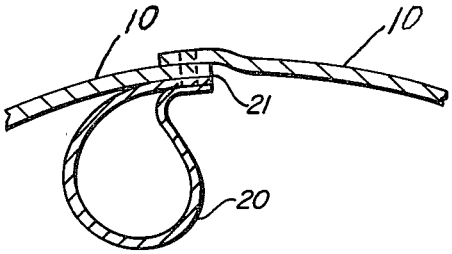
FIG. 3A shows a modification of the structure of FIG. 3.

To guide the lower end of the rod 15 toward the lower socket 11, and to hold the rod against the bag body 10, I prefer to use a sheath 17. This sheath may be formed of the same material as the bag body and is sewed, as shown in FIG. 3, to the bag body at 18. In the modification of FIG. 3A, the sheath is designated 20 and is formed of a strip of material doubled over and sewed to the opposed vertical edges of body 10 as body 10 is itself sewed.

Figure 6:
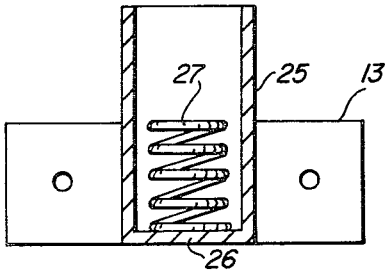
FIG. 6 is an elevation and partial section of a socket containing a compression spring.

Because of manufacturing tolerances, I may use a modified socket shown in FIG. 6. This socket has a tubular body 25 closed at its bottom 26 and holding a compression spring 27. This spring resists entry of a rod into the socket and will at all times press a rod toward the opposed socket.

Figure 8:
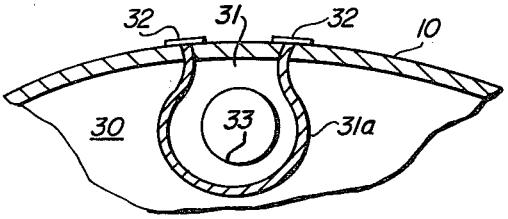
FIG. 8 shows a modified socket part.

In this application the word socket is used broadly. As seen in FIG. 8, the socket may comprise bottom plate 30 of the bag, and a spaced plate 31. Plate 31 is relatively small and has for strength an integral rim shown in section at 31*a*. The rim pierces the cloth of the bag at two points and is secured at those points by fasteners 32. Plate 31 has an opening for the entry of the rod end which will go through the opening 33 and will rest against the bottom plate 30.

Figure 9:
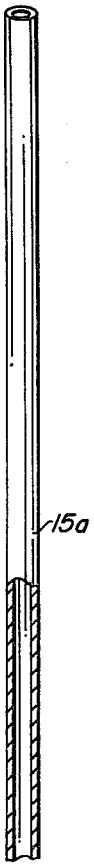
FIG. 9 shows a tubular type or rod.
Figure 10:
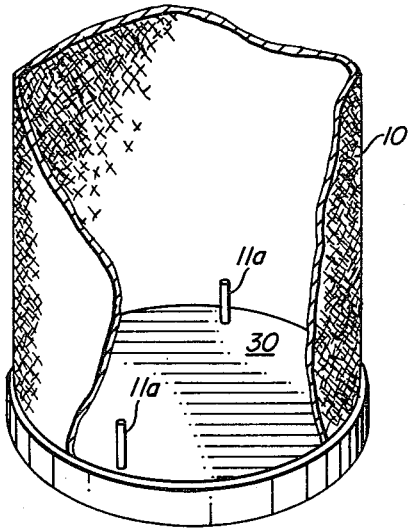
FIG. 10 shows a pin type of socket for use therewith.

Those skilled in the art will also appreciate that the rod and socket relationship may be reversed at one or both ends of the rod. Thus, in FIG. 10 the base or bottom plate of the golf bag is formed with one or more pins 11*a* when it is molded. The rod used to interlock with the pins is tubular as shown in FIG. 9, although it may be formed with bores only at its ends. Obviously, the tubular ends of the rod 15*a* will fit over pins 11*a*, at each end of the golf bag. I do believe the broad aspects of my contribution will be understood.

I claim:

1. A golf bag having a collapsible longitudinal tubular body, means for holding said body in a longitudinal extended position against collapse comprising flexing rod means and opposed socket means, said socket means being internal of said body and fixed relatively to opposed ends of said body, said flexing rod means being freely insertible within said body for flexing within said body for shortening the effective length of said flexing rod means while within said body, the opposed ends of said flexing rod means engaging the opposed socket means through the flexing of the flexing rod means to reduce the effective length thereof to align the opposed ends of said flexing rod means with said socket means, and the release of said flexing rod means from flexing allowing said flexing rod means to assume a length to effect retention of the flexing rod means relatively to said opposed socket means, and said flexing rod means being freely removable from said socket means upon flexing thereof.

2. In claim 1, the feature that longitudinal movement of at least one end of said flexing rod means relatively to a socket means is required to effect engagement of said end and said socket means.

3. In the combination of claim 1, the feature that at least one of said socket means has a bore for the entry of an end of said flexing rod means.

4. In the combination of claim 1, the feature that at least one of said socket means is a pin engaged by a bore at an end of said flexing rod means.

5. In the combination of claim 1, the feature of spring means yieldingly resisting engagement of at least one end of said flexing rod means with one of said sockets.

* * * * *